US009356386B2

(12) United States Patent
Chiba et al.

(10) Patent No.: US 9,356,386 B2
(45) Date of Patent: May 31, 2016

(54) CONNECTOR

(71) Applicant: Yazaki Corporation, Tokyo (JP)

(72) Inventors: Shingo Chiba, Shizuoka (JP); Naokazu Nagasaka, Shizuoka (JP); Toshiaki Okabe, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/844,549

(22) Filed: Sep. 3, 2015

(65) Prior Publication Data

US 2016/0072218 A1 Mar. 10, 2016

(30) Foreign Application Priority Data

Sep. 4, 2014 (JP) ..... 2014-180077

(51) Int. Cl.
*H01R 13/40* (2006.01)
*H01R 13/52* (2006.01)
*H01R 13/422* (2006.01)

(52) U.S. Cl.
CPC ..... *H01R 13/5202* (2013.01); *H01R 13/4223* (2013.01)

(58) Field of Classification Search
CPC .. H01R 13/5202; H01R 13/42; H01R 13/422; H01R 13/424; H01R 13/4223
USPC ..... 439/587, 589, 733.1, 744, 745
See application file for complete search history.

(56) References Cited

U.S. PATENT DOCUMENTS 5,993,255 A * 11/1999 Yurko ..... H01R 13/631 439/364
7,635,286 B1 * 12/2009 Morello ..... H01R 13/41 439/752.5
7,780,485 B2 * 8/2010 Morello ..... H01R 13/422 439/752
8,376,778 B2 * 2/2013 Obata ..... H01R 13/4223 439/595
9,093,770 B2 * 7/2015 Mumper ..... H01R 13/4223

FOREIGN PATENT DOCUMENTS

JP 2014-89929 A 5/2014

* cited by examiner

*Primary Examiner* — Khiem Nguyen
(74) *Attorney, Agent, or Firm* — Sughrue Mion, PLLC

(57) ABSTRACT

A connector includes a rib provided in a male terminal housing chamber of a male connector and configured to suppress a relative displacement of a male terminal to the male terminal housing chamber by being brought into contact with the male terminal and a rib provided in a female terminal housing chamber of a female connector and configured to suppress a relative displacement of a female terminal to the female terminal housing chamber by being brought into contact with the female terminal. The rib is formed so as to start to come into contact with the male terminal at a tab exit port side position than a position where a required insertion force becomes maximum. The rib is formed so as to start to come into contact with the female terminal at a tab insertion port side position than a position where the required insertion force becomes maximum.

6 Claims, 11 Drawing Sheets

CONNECTOR

CROSS-REFERENCE TO RELATED APPLICATIONS

The present application claims priority to and incorporates by reference the entire contents of Japanese Patent Application No. 2014-180077 filed in Japan on Sep. 4, 2014.

BACKGROUND OF THE INVENTION

1. Field of the Invention

The present invention relates to a connector.

2. Description of the Related Art

Conventionally, in a connector of a type in which a conductive connection between a male terminal and a female terminal allows wires connected to the respective terminals to be electrically connected to each other, when vibration is transmitted to the connector through the wire connected to the terminal, a relative displacement (backlash) may occur between the male and female terminals to impair contact stability of a contact portion between terminals. Japanese Patent Application Laid-open No. 2014-89929 discloses technology related to a waterproof connector, in which a rubber plug to be inserted into an inlet of a terminal cavity is constituted by a high hardness part and a low hardness part. This allows the vibration from the wire to be absorbed so as to ensure the contact stability of the contact portion between the terminals.

However, application of the technology described in Patent Document 1 is limited to only to the waterproof connector. As described above, a conventional connector has still room for improvement in terms of the contact stability of the contact portion between the male and female terminals.

SUMMARY OF THE INVENTION

The present invention has been made in view of the above situation, and an object thereof is to provide a connector capable of improving the contact stability of the contact portion between the male and female terminals.

According to one aspect of the present invention, a connector includes a male connector including a male housing, a male terminal having a tab at a leading end thereof, and a male terminal housing chamber configured to extend inside the male housing, be formed in a hollow shape, and have a male terminal insertion port and a tab exit port provided at first and second sides thereof in its extending direction, respectively; and a female connector including a female housing, a female terminal configured to have an elastic contact piece contacting the tab of the male terminal inserted thereinto, and a female terminal housing chamber configured to extend inside the female housing, be formed in a hollow shape, and have a female terminal insertion port and a tab insertion port provided at the second and first sides thereof in its extending direction, respectively, wherein the male and female connectors are configured to have at least one of a first and second displacement suppressing portions, the first displacement suppressing portion being provided in the male terminal housing chamber and configured to suppress a relative displacement of the male terminal to the male terminal housing chamber by being brought into contact with the male terminal accommodated in the male terminal housing chamber, the second displacement suppressing portion being provided in the female terminal housing chamber and configured to suppress a relative displacement of the female terminal to the female terminal housing chamber by being brought into contact with the female terminal accommodated in the female terminal housing chamber, the first displacement suppressing portion is formed so as to start to come into contact with the male terminal at a tab exit port side position than a position where a required insertion force capable of moving the male terminal in the extending direction becomes maximum in an insertion operation of inserting the male terminal from the male terminal insertion port so as to accommodate the male terminal at a predetermined normal position in the extending direction inside the male terminal housing chamber, the second displacement suppressing portion is formed so as to start to come into contact with the female terminal at a tab insertion port side position than a position where a required insertion force capable of moving the female terminal in the extending direction becomes maximum in an insertion operation of inserting the female terminal from the female terminal insertion port so as to accommodate the female terminal at a predetermined normal position in the extending direction inside the female terminal housing chamber.

Further, in the connector, it is preferable that the male connector has a lance, the lance being formed so as to protrude from an inner wall surface of the male terminal housing chamber toward an inside thereof and to be elastically deformable toward an outside of the male terminal housing chamber and being configured to lock the male terminal when the male terminal is accommodated at the normal position, the first displacement suppressing portion has a rib provided on the inner wall surface, along the extending direction, at the tab exit port side position than the lance, the female connector has a lance, the lance being formed so as to protrude from an inner wall surface of the female terminal housing chamber toward an inside thereof and to be elastically deformable toward an outside of the female terminal housing chamber and being configured to lock the female terminal when the female terminal is accommodated at the normal position, and the second displacement suppressing portion has a rib provided on the inner wall surface, along the extending direction, at the tab insertion port side position than the lance.

Further, in the connector, it is preferable that the male terminal housing chamber and female terminal housing chamber are each formed by a plurality of the inner wall surfaces, and the first and second displacement suppressing portions have at least two ribs on one of the plurality of inner wall surfaces.

Further, in the connector, it is preferable that in a state where the male and female terminals are fitted to each other, the first and second displacement suppressing portions are formed so as to ensure a gastight area at a contact portion between the tab of the male terminal and the elastic contact piece of the female terminal.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
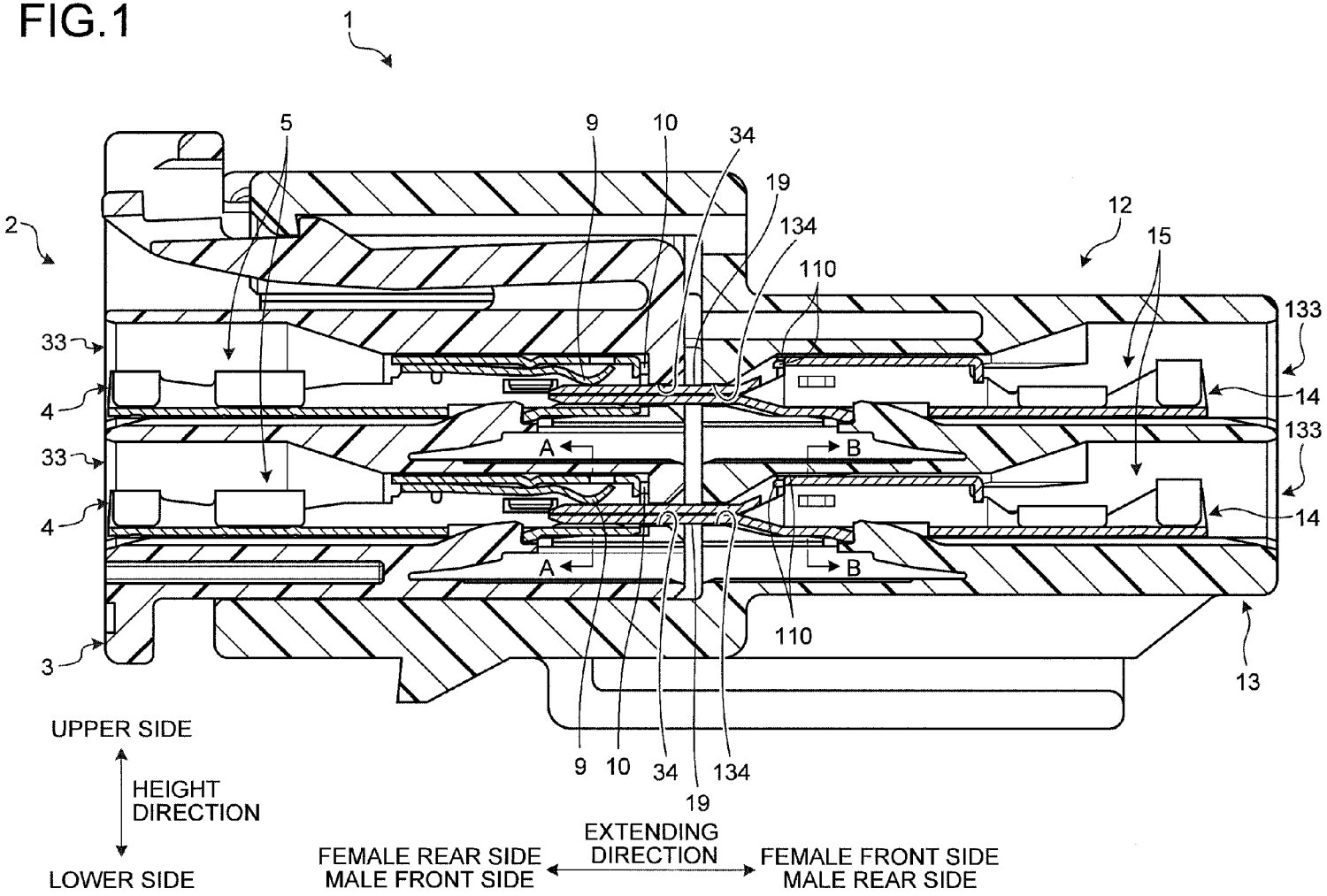
FIG. 1 is a longitudinal cross-sectional view schematically illustrating a configuration of a connector according to an embodiment of the present invention.

Hereinafter, an embodiment of a connector according to the present invention will be described based on the drawings. Throughout the drawings, the same reference numerals are used to designate the same or similar components, descriptions thereof are not repeated.

EMBODIMENT

Figure 2:
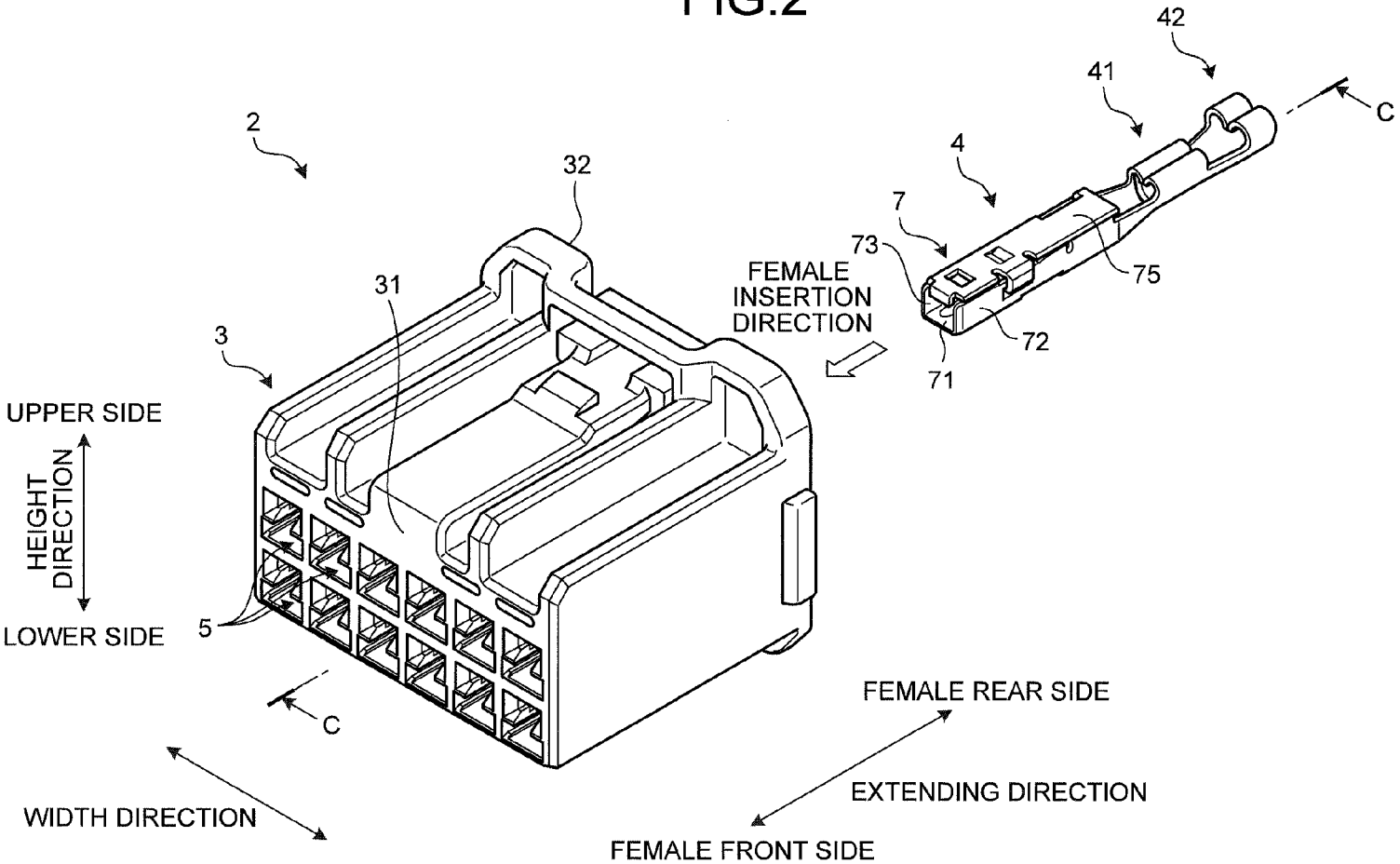
FIG. 2 is an exploded perspective view schematically illustrating a configuration of a female connector illustrated in FIG. 1.
Figure 3:
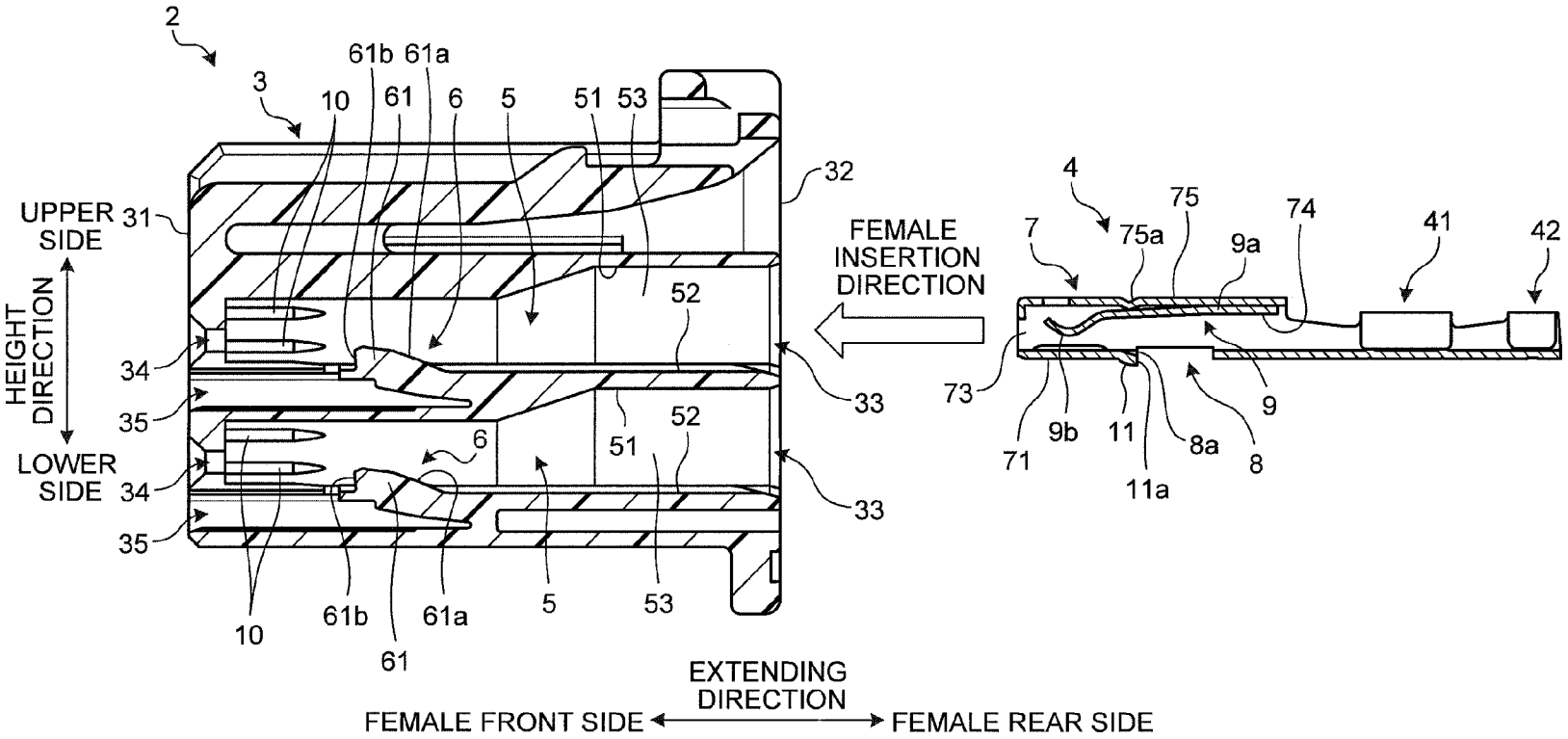
FIG. 3 is a cross-sectional view taken along a line C-C in FIG. 2.
Figure 4:
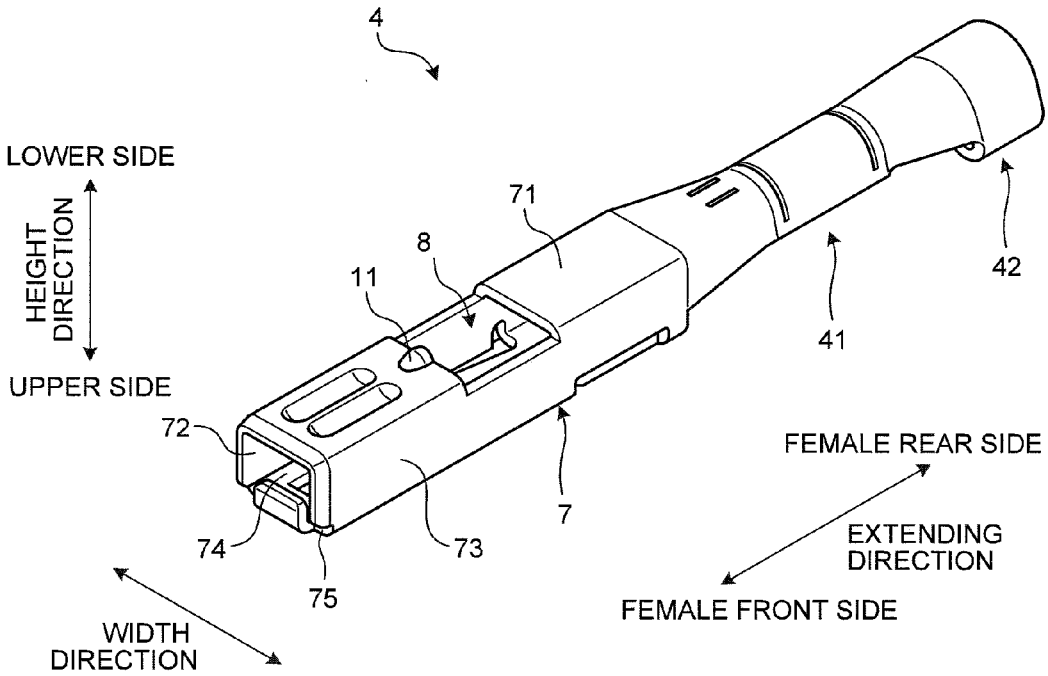
FIG. 4 is a perspective view of a female terminal illustrated in FIG. 2 as viewed from below in a height direction.
Figure 5:
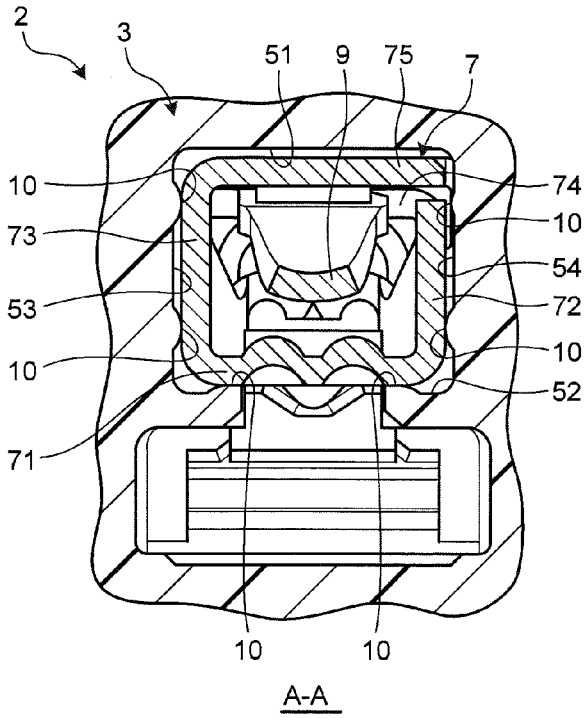
FIG. 5 is a cross-sectional view taken along a line A-A in FIG. 1, illustrating the female connector as viewed in an extending direction thereof.
Figure 6:
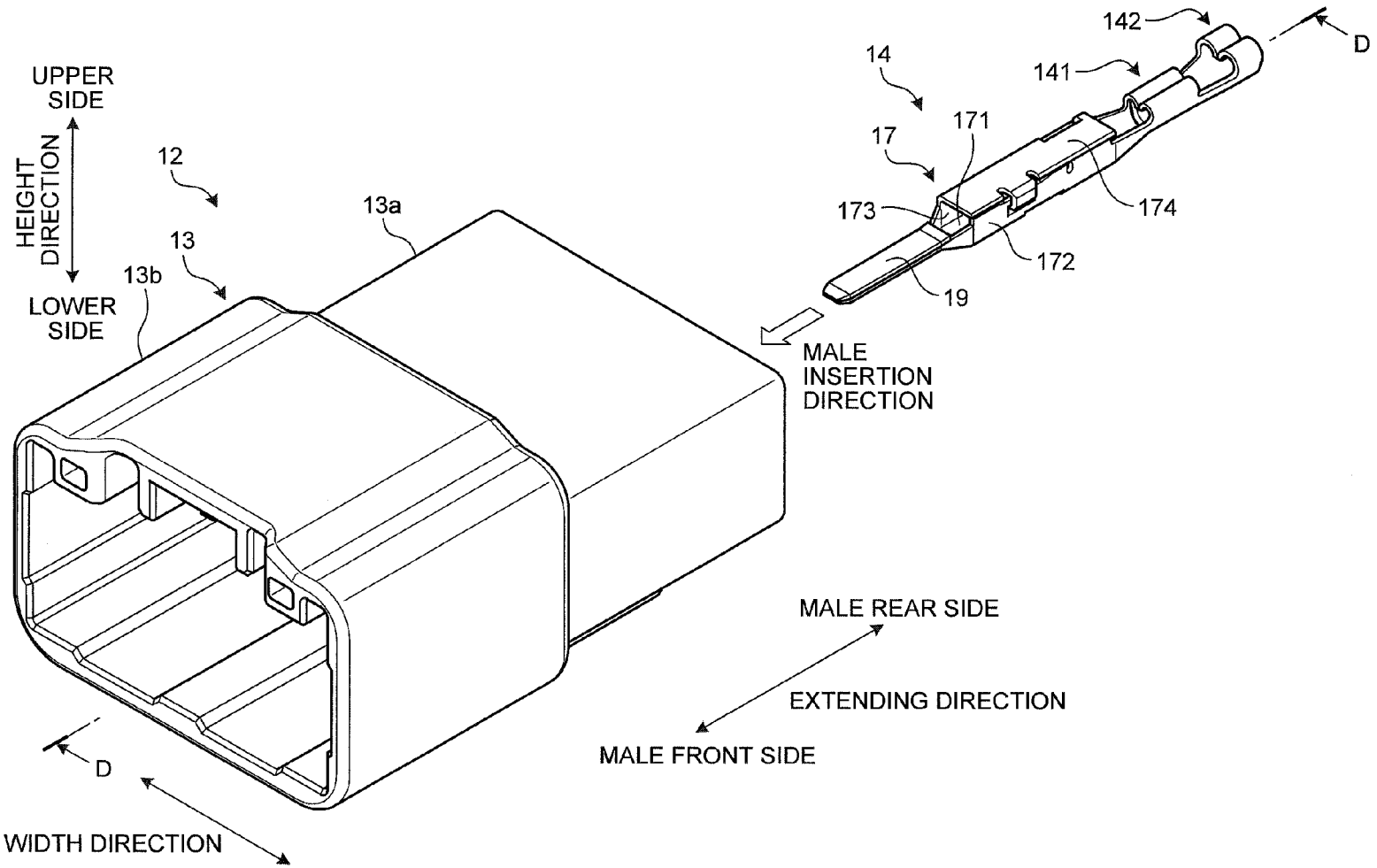
FIG. 6 is an exploded perspective view schematically illustrating a configuration of a male connector illustrated in FIG. 1.
Figure 7:
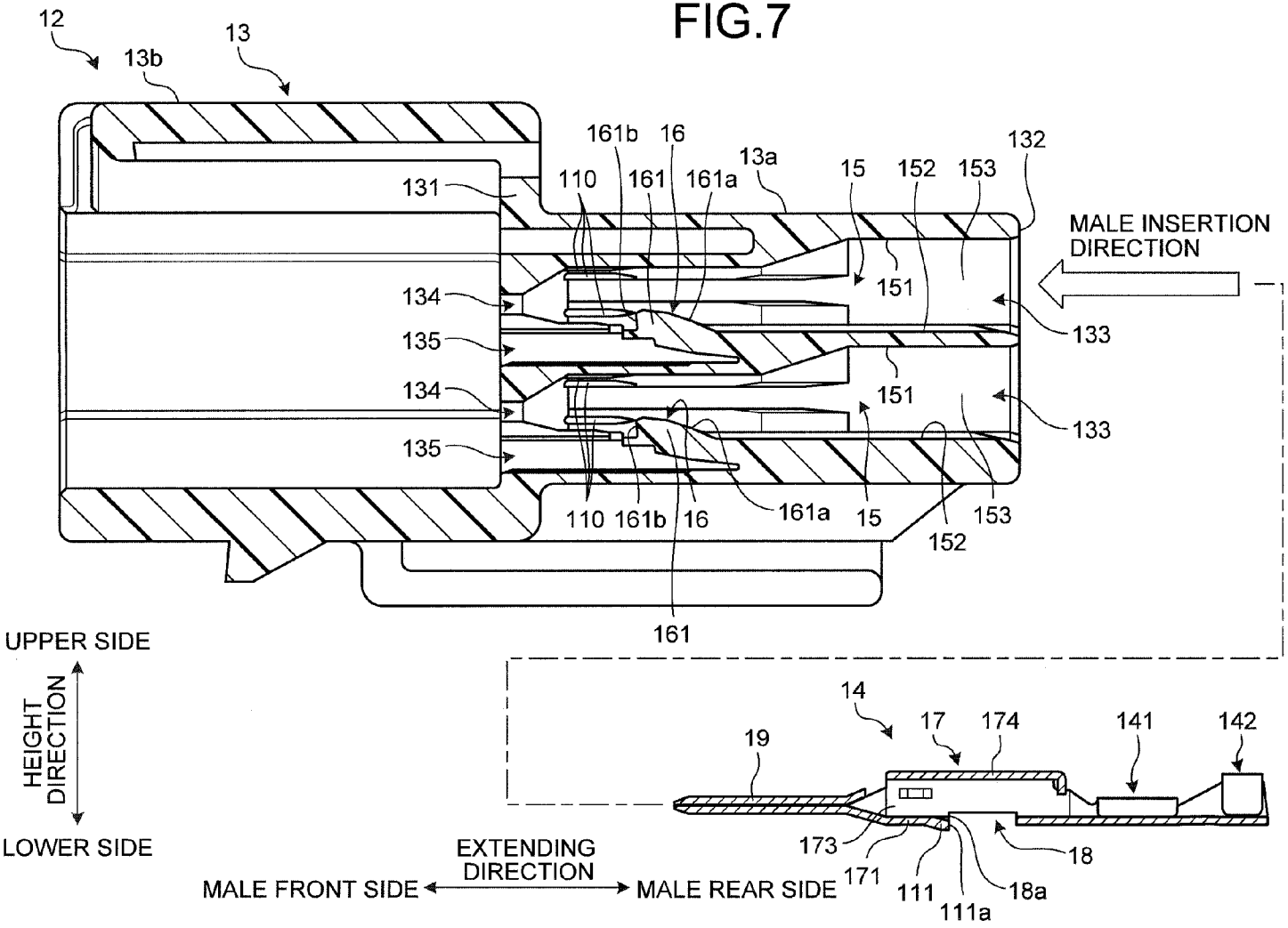
FIG. 7 is a cross-sectional view taken along a line D-D in FIG. 6.
Figure 8:
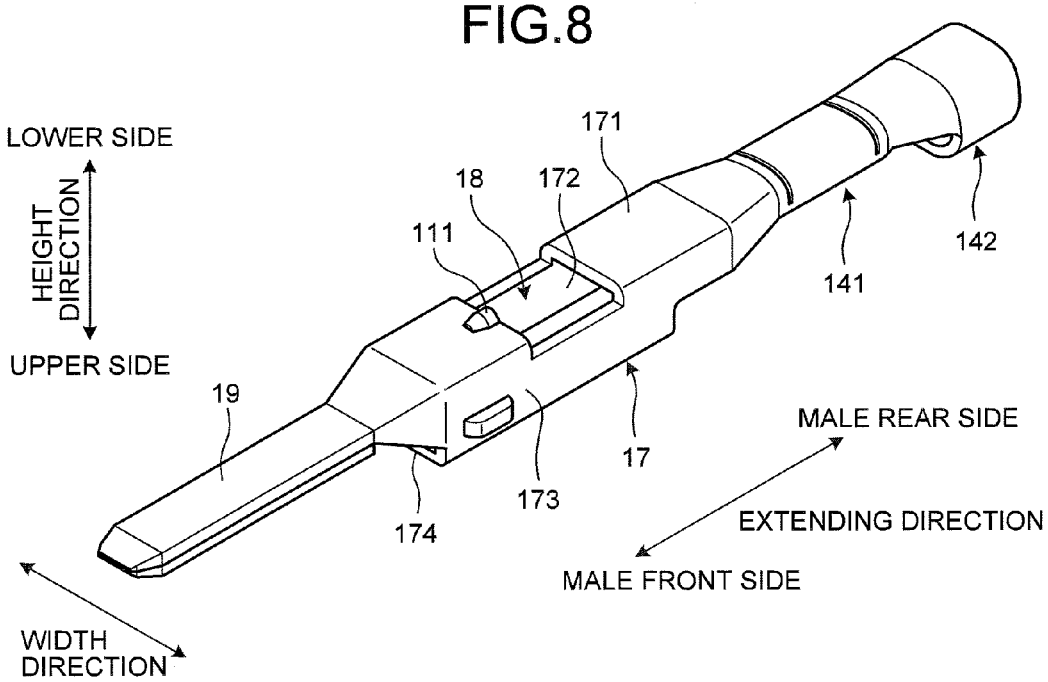
FIG. 8 is a perspective view of a male terminal illustrated in FIG. 6 as viewed from below in the height direction.
Figure 9:
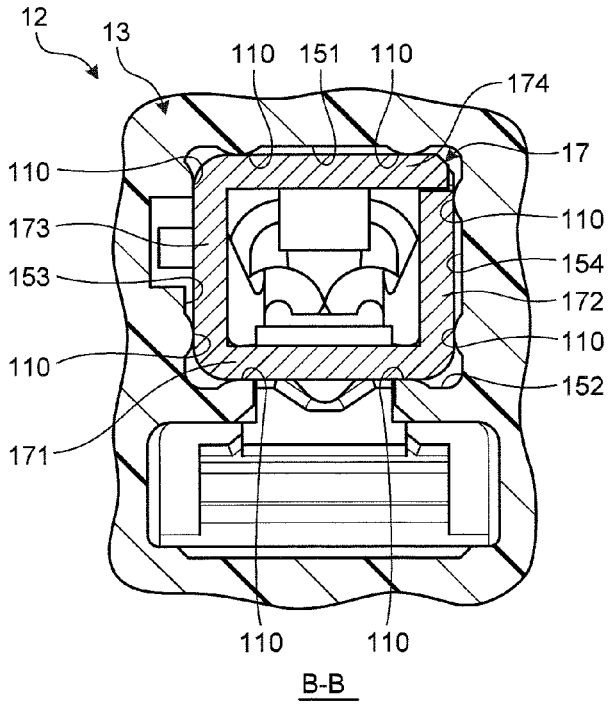
FIG. 9 is a cross-sectional view taken along a line B-B in FIG. 1, illustrating the male connector as viewed in an extending direction thereof.

A configuration of a connector according to an embodiment of the present invention will be described with reference to FIGS. 1 to 9. FIG. 1 is a longitudinal cross-sectional view schematically illustrating a configuration of the connector according to the embodiment of the present invention. FIG. 2 is an exploded perspective view schematically illustrating a configuration of a female connector illustrated in FIG. 1. FIG. 3 is a cross-sectional view taken along a line C-C in FIG. 2. FIG. 4 is a perspective view of a female terminal illustrated in FIG. 2 as viewed from below in a height direction. FIG. 5 is a cross-sectional view taken along a line A-A in FIG. 1, illustrating the female connector as viewed in an extending direction thereof. FIG. 6 is an exploded perspective view schematically illustrating a configuration of a male connector illustrated in FIG. 1. FIG. 7 is a cross-sectional view taken along a line D-D in FIG. 6. FIG. 8 is a perspective view of a male terminal illustrated in FIG. 6 as viewed from below in the height direction. FIG. 9 is a cross-sectional view taken along a line B-B in FIG. 1, illustrating the male connector as viewed in an extending direction thereof.

As illustrated in FIG. 1, a connector 1 according to the present embodiment includes a female connector 2 and a male connector 12. The connector 1 can conductively connect a female terminal 4 and a male terminal 14 to each other by fitting the female connector 2 and male connector 12, accommodating the female terminal 4 and the male terminal 14 respectively, to each other. The connector 1 has a connection mechanism for so-called wire-to-wire connection that conductively connects the female terminal 4 and male terminal 14 to thereby electrically connect wires connected respectively to the terminals 4 and 14.

As illustrated in FIGS. 1 to 3, the female connector 2 includes a female housing 3 and the female terminal 4.

The female housing 3 is a structure that constitutes a main body of the female connector 2. The female housing 3 is formed of an insulating synthetic resin as a whole and integrally molded using a die and the like. The female housing 3 has a substantially rectangular box (rectangular parallelepiped) shape as a whole. The female housing 3 has a plurality of female terminal housing chambers 5 (cavities) each extending therein, formed in a hollow shape, and configured to accommodate the female terminal 4. As illustrated in FIG. 2, in the female housing 3 of the present embodiment, when viewing a front surface 31 which is one of outer surfaces constituting the substantially rectangular box shape, six female terminal housing chambers 5 are adjacently arranged along a first side direction (width direction in FIG. 2) of the front surface 31, and two female terminal housing chambers 5 are adjacently arranged along a second side direction (height direction in FIG. 2) perpendicular to the first side direction. That is, 12 (6×2) female terminal housing chambers 5 are provided in the female housing 3. The 12 female terminal housing chambers 5 are formed so as to extend in the same direction, i.e., in a direction (extending direction illustrated in FIG. 2) in which the front surface 31 of the female housing 3 and a rear surface 32 disposed at an opposite side to the front surface 31 are opposed to each other.

As illustrated in FIG. 3, for insertion of the female terminal 4 into the female terminal housing chamber 5, a female terminal insertion port 33 is formed on the rear surface 32 of the female housing 3 communicated with each female terminal housing chamber 5. Further, a tab insertion port 34 is formed on the front surface 31 of the female housing 3 communicated with each female terminal housing chamber 5. The tab insertion port 34 allows a tab 19 (to be described later) of the male terminal 14 to enter the female terminal housing chamber 5. That is, the female terminal housing chamber 5 extends inside the female housing 3, formed in a hollow shape, and opened to both ends in the extending direction thereof, i.e., to the pair of opposing front and rear surfaces 31 and 32 of the female housing 3.

As illustrated in FIGS. 3 and 5, the female terminal housing chamber 5 is formed as a substantially rectangular space defined by four inner wall surfaces of the female housing 3, more in detail, a first inner wall surface 51, a second inner wall surface 52, a third inner wall surface 53, a fourth inner wall surface 54, and the like. The first and second inner wall surfaces 51 and 52 are opposed to each other. The third and fourth inner wall surfaces 53 and 54 are opposed to each other and each substantially perpendicular to both the first and second inner wall surfaces 51 and 52.

In the following description, the direction in which the female terminal housing chamber 5 illustrated in FIGS. 2 and 3 extends, that is, the direction (left-right direction in FIG. 3) in which the pair of front and rear surfaces 31 and 32 of the female housing 3 are opposed to each other is referred to as "extending direction". In the extending direction, a side at which the front surface 31 is provided is referred to as "female front side", and a side at which the rear surface 32 is provided is referred to as "female rear side". Further, a direction (up-down direction in FIG. 3) in which the first and second inner wall surfaces 51 and 52 of the female terminal housing chamber 5 illustrated in FIG. 3 are opposed to each other is referred to as "height direction". In the height direction, a side at which the first inner wall surface 51 is provided is referred to as "upper side", and a side at which the second inner wall surface 52 is provided is referred to as "lower side". Further, a direction (depth direction in FIG. 3) in which the third and fourth inner wall surfaces 53 and 54 of the female terminal housing chamber 5 are opposed to each other is referred to as "width direction". That is, in the present embodiment, the female terminal housing chambers 5 each formed inside the female housing 3 along the extending direction are arranged in 2×6 matrix in the height direction and width direction, respectively. The female terminal 4 is inserted inside the female terminal housing chamber 5 from the female terminal insertion port 33 provided at the female rear side of the female housing 3 in the extending direction toward the female front side in the extending direction. In the following description, as illustrated in FIGS. 2 and 3, the extending direction directed from the female rear side to the female front side is sometimes referred to as "female insertion direction". Further, as illustrated in FIG. 1, the male connector 12 is disposed opposite to the female connector 2 along the extending direction, so that the female front side in the extending direction is sometimes referred to as "male rear side", and the female rear side is referred to as "male front side". Further, the extending direction directed from the male rear side to the male front side is sometimes referred to as "male insertion direction".

As illustrated in FIG. 3, an elastically deformable lance 6 is provided in the second inner wall surface 52 of the female terminal housing chamber 5 so as to protrude from the second inner wall surface 52 toward an inner space side of the female terminal housing chamber 5. The lance 6 can lock the female terminal 4 in a state where the female terminal 4 is accommodated at a predetermined normal position in the extending direction inside the female terminal housing chamber 5 (see FIG. 1, etc.). This prevents the female terminal 4 from slipping out of the female terminal housing chamber 5 from the female terminal insertion port 33.

As illustrated in FIG. 3, the lance 6 extends from a base end portion on the second inner wall surface 52 to a front side in the extending direction and is formed in a cantilever shape, in which a leading end portion thereof is a free end. That is, the base end portion of the lance 6 is disposed at the rear side in the extending direction, and the leading end portion of the lance 6 is disposed at the front side in the extending direction. The leading end portion is elastically bendable/deformable in the height direction with the base end portion as a fulcrum.

A locking pawl portion 61 (beak) for locking the female terminal 4 is provided on a surface of the lance 6 disposed at the leading end portion side and at the upper side in the height direction (i.e., inner space side of the female terminal housing chamber 5). When the lance 6 is in a free state where it is not bent/deformed, the locking pawl portion 61 is positioned at the upper side of the second inner wall surface 52 of the female terminal housing chamber 5 in the height direction, that is, protrudes toward the inner space of the female terminal housing chamber 5. When the female terminal 4 is accommodated at a predetermined normal position inside the female terminal housing chamber 5 (see FIG. 1, etc.), the locking pawl portion 61 of the lance 6 is fitted in a lance hole 8 of the female terminal 4, thereby locking the female terminal 4.

The locking pawl portion 61 has a slope 61*a* inclining upward toward the front side in the extending direction so as to gradually protrude toward the female terminal housing chamber 5 as it goes from the base end portion of the lance 6 toward the leading end side thereof and a locking surface 61*b* formed in a step shape bent downward in the height direction from a front end portion of the slope 61*a* in the extending direction. The locking surface 61*b* is a front side end surface of the locking pawl portion 61 in the extending direction and is formed in a planar shape substantially perpendicular to the extending direction (insertion direction of the female terminal 4 into the female terminal housing chamber 5). The slope 61*a* is a part of the lance 6 that the female terminal 4 contacts first in an insertion process of the female terminal 4 into the female terminal housing chamber 5, and the locking surface 61*b* is a part of the lance 6 that contacts the female terminal 4 in a state where the female terminal 4 is accommodated at a normal position inside the female terminal housing chamber 5. When the female terminal 4 is inserted into the female terminal housing chamber 5, a leading end of the female terminal 4 abuts against the slope 61*a*, causing a component force that presses down the entire lance 6. The lance 6 is bent downward in the height direction by the component force received by the slope 61*a* to retreat outside the female terminal housing chamber 5. The locking surface 61*b* is locked to a locked portion (in the present embodiment, a front end surface 8*a* of the lance hole 8 to be described later) formed in the female terminal 4 in a state where the entire lance 6 is elastically restored, to thereby restrict escape of the female terminal 4. In a state where the locking surface 61*b* of the locking pawl portion 61 is locked to the locked portion of the female terminal 4, the lance 6 locks the female terminal 4 at a predetermined normal position in the extending direction inside the female terminal housing chamber 5.

As illustrated in FIG. 3, the female housing 3 is provided with an adjacent space portion 35 for every female terminal housing chamber 5 adjacent to the female terminal housing chamber 5. The adjacent space portion 35 is formed in a hollow shape so as to extend in parallel to the extending direction of its adjacent female terminal housing chamber 5 and is opened to the front surface 31 of the female housing 3. Further, when viewing the front surface 31 of the female housing 3, the adjacent space portion 35 is disposed adjacent to the lower side in the height direction of the tab insertion port 34 of its adjacent female terminal housing chamber 5. That is, the adjacent space portion 35 is formed at a side at which the lance 6 is provided with respect to the adjacent female terminal housing chamber 5, i.e., the second inner wall surface 52 side. The adjacent space portion 35 extends from the front surface 31 of the female housing 3 to the base end portion of the lance 6. The adjacent space portion 35 functions as a bending space that allows the lance 6 of the adjacent female terminal housing chamber 5 to be elastically bent/deformed downward in the height direction, i.e., in a direction separating from the female terminal housing chamber 5. The lance 6 retreats to the adjacent space portion 35 when being bent/deformed. The adjacent space portion 35 is, for example, a space for die-cutting to be used in formation of the lance 6 provided in the female terminal housing chamber 5.

The female terminal 4 is a terminal fitting having a predetermined shape, which is obtained by punching a conductive metal plate into a predetermine shape, followed by hammering or bending. As illustrated in FIGS. 2 to 4, the female terminal 4 has a box portion 7 configured to receive insertion of a tab 19 of the male terminal 14, a core wire caulking portion 41 caulked to a core of the wire, and a wire caulking portion 42 caulked to a covering portion of the wire. The female terminal 4 integrally includes the box portion 7, core wire caulking portion 41, and wire caulking portion 42 in this order from the front side in the extending direction.

The box portion 7 has a rectangular cylindrical shape elongated in the extending direction and is opened both to the front and rear sides in the extending direction. As illustrated in FIG. 5, the box portion 7 has a substantially rectangular shape in cross section as viewed in the extending direction. The box portion 7 has a bottom plate 71 extending in the extending direction, a pair of side plates 72 and 73 rising in the height direction from width direction both edge ends of the bottom plate 71, a top plate 74 formed so as to be bent from a protruding end (upper edge end) of the side plate 72 toward the side plate 73 and to be disposed opposite to the bottom plate 71, and an outer plate 75 formed so as to be bent from a protruding end of the side plate 73 and to overlap the top plate 74 from outside.

As illustrated in FIG. 3, a plate spring-shaped contact spring 9 (elastic contact piece, biasing portion) is provided in the hollow portion of the box portion 7. The contact spring 9 extends in a cantilever state from a rear side end portion of the top plate 74 in the extending direction toward the front side in the extending direction along an inner surface of the outer plate 75. A front end portion of the contact spring 9 is a free end. A support portion 9*a* positioned at the rear side of the contact spring 9 in the extending direction is provided such that a rear half part thereof contacts the outer plate 75 and a front half part thereof is slightly separated from the outer plate 75 by presence of a fulcrum portion 75*a* formed so as to protrude from an inner surface of the outer plate 75. An apex portion is positioned frontward of the support portion 9*a*, which is obtained by bending a front portion of the contact spring 9 toward the bottom plate 71 opposite to the outer plate 75. At the apex portion, a contact portion 9*b* is embossed to the bottom plate 71 so as to allow contact with the tab 19 of the male terminal 14 (see FIG. 1). The contact portion 9*b*, when being in a free state, is protruded up to a region through which the inserted tab 19 passes. When the tab 19 is inserted into the box portion 7, the contact portion 9*b* of the contact spring that contacts the tab 19 is pushed to the outer plate 75 side. This causes a leading end portion of the contact spring 9 to be elastically deformed to the outer plate 75 side with a contact portion between the support portion 9*a* and fulcrum portion 75*a* as a center, whereby the contact portion 9*b* is biased to the bottom plate 71 side. As a result, the tab 19 of the male terminal 14 inserted into the box portion 7 is pressured toward the bottom plate 71 side by the contact portion 9*b*.

As illustrated in FIGS. 3 and 4, a lance hole 8 (locked portion) communicated with the inside of the female terminal 4 is formed in the bottom plate 71 of the box portion 7. As illustrated in FIG. 4, the lance hole 8 is an opening portion formed over the entire width of the bottom plate 71 in the width direction at a substantially center position of the box portion 7 in the extending direction. The bottom plate 71 is divided into a front side part and a rear side part in the extending direction by the lance hole 8. In a state where the female terminal 4 is accommodated at a normal position in the female terminal housing chamber 5, the lance 6 provided in the female terminal housing chamber 5 can enter the lance hole 8, and the locking surface 61*b* of the lance 6 can be locked to the front end surface 8*a* of the lance hole 8 positioned at an extending direction front side in the extending direction (see FIGS. 1 and 15).

As illustrated in FIGS. 3 and 4, a protrusion 11 is formed at a substantially center position of a front side part of an outer edge of the lance hole 8 so as to protrude outward (downward in the height direction). In other words, the protrusion 11 is formed at a part of the outer edge of the lance hole 8 that abuts against the slope 61*a* of the lance 6 in a process in which the female terminal 4 is accommodated at a normal position in the female terminal housing chamber 5. Further, the protrusion 11 is formed such that a rear end surface 11*a* thereof in the extending direction is aligned with the front end surface 8*a* of the lance hole 8. That is, the rear end surface 11*a* of the protrusion 11 and front end surface 8*a* of the lance hole 8 form the same plane. When the lance 6 is fitted to the female terminal 4, the rear end surface 11*a* of the protrusion 11 and front end surface 8*a* of the lance hole 8 abut against the locking surface 61*b* of the lance 6.

As illustrated in FIGS. 1, 3, and 5, a plurality of ribs 10 (second displacement suppressing portion) are formed in each of the second, third, and fourth inner wall surfaces 52, 53, and 54 of the female terminal housing chamber 5 so as to protrude from each inner wall surface toward the inner space side of the female terminal housing chamber 5. The ribs 10 are each formed so as to extend in the extending direction at the tab insertion port 34 side position than the lance 6 on each inner wall. The ribs 10 are configured to be able to suppress movement of the female terminal 4 in the female terminal housing chamber 5 by coming into contact with the box portion 7 of the female terminal 4 in a state where the female terminal 4 is accommodated at a normal position in the female terminal housing chamber 5. In other words, when being brought into contact with the female terminal 4 accommodated in the female terminal housing chamber 5, the ribs 10 can firmly retain the female terminal 4 in the female terminal housing chamber 5 and can suppress a relative displacement of the female terminal 4 to the female terminal housing chamber 5. Thus, even if vibration is transmitted from the wire connected to the female terminal 4 upon connector fitting, it is possible to suppress vibration from being generated in the female terminal 4 to thereby suppress the vibration from being transmitted to the male terminal 14 side. The relative displacement of the female terminal 4 to the female terminal housing chamber 5 refers mainly to perturbation (backlash) along the height direction perpendicular to the female insertion direction, but includes also perturbation, movement, and displacement of the female terminal 4 along directions other than the height direction.

There are provided two ribs 10 on each inner wall surface. As a result, it is possible to satisfactorily maintain contact states with the bottom plate 71, side plates 72, 73 of the box portion 7 of the female terminal 4 and corresponding inner walls, respectively. That is, in the present embodiment, the ribs 10 are provided at six places in the female terminal housing chamber 5. Although in the present embodiment, the ribs 10 are not provided on the first inner wall surface 51 of the female terminal housing chamber 5; however, the present invention is not limited to this, the ribs 10 may be provided also on the first inner wall surface 51, and the ribs 10 may be provided on all the inner wall surfaces in the female terminal housing chamber 5. Further, a configuration may be possible, in which the ribs 10 are not provided on the inner wall surface other than the first inner wall surface 51.

The ribs 10 are provided at the tab insertion port 34 side position than the lance 6 on each inner wall. With this configuration, in an insertion operation of the female terminal 4 (operation of inserting the female terminal 4 from the female terminal insertion port 33 so as to accommodate the female terminal 4 at a predetermined normal position in the extending direction inside the female terminal housing chamber 5), the ribs 10 start to come into contact with the female terminal 4 at the tab insertion port 34 side position than a position where a required insertion force for moving the female terminal 4 in the extending direction becomes maximum. As a result, the female connector 2 of the present embodiment can retain the female terminal 4 in the female terminal housing chamber 5 more firmly without increasing the maximum value of the required insertion force. That is, it is possible to achieve both suppression of the relative displacement of the female terminal 4 to the female terminal housing chamber 5 and securement of easy insertion of the female terminal 4 into the female terminal housing chamber 5.

As illustrated in FIGS. 1, 6, and 7, the male connector 12 has a male housing 13 and a male terminal 14.

The male housing 13 is a structure that constitutes a main body of the male connector 12. Like the female housing 3, the male housing 13 is formed of an insulating synthetic resin as a whole and integrally molded using a die. The male housing 13 has a terminal accommodating portion 13*a* and a fitting hood portion 13*b*.

As illustrated in FIG. 7, the terminal accommodating portion 13*a* has the same structure as that of the female housing 3 and has a plurality of male terminal housing chambers 15 each capable of accommodating the male terminal 14. The number and arrangement of the male terminal housing chambers 15 are the same as those of the female terminal housing chambers 5 of the female housing 3.

For insertion of the male terminal 14 into the male terminal housing chamber 15, a male terminal insertion port 133 is formed on a rear surface 132 of the terminal accommodating portion 13*a* communicated with each male terminal housing chamber 15. Further, a tab exit port 134 is formed on a front surface 131 of the terminal accommodating portion 13*a* communicated with each male terminal housing chamber 15. The tab exit port 134 allows the tab 19 of the male terminal 14 accommodated in the male terminal housing chamber 15 to exit from the male terminal housing chamber 15 to be exposed outside. That is, the male terminal housing chamber 15 extends inside the terminal accommodating portion 13*a* of the male housing 13, formed in a hollow shape, and opened to both ends in the extending direction thereof, i.e., to the pair of opposing front and rear surfaces 131 and 132 of the male housing 13.

The fitting hood portion 13*b* is a cylindrical member opened to the male front side in the extending direction. The fitting hood portion 13*b* is connected to the front surface 131 side of the terminal accommodating portion 13*a* and is formed into a cylindrical shape along an outer shape of the front surface 131. That is, the tab exit port 134 provided on the front surface 131 of the terminal accommodating portion 13*a* is opened to an inner space of the fitting hood portion 13*b*, and the tab 19 of the male terminal 14 to be made to exit from the tab exit port 134 is exposed to the inner space of the fitting hood portion 13*b*.

The fitting hood portion 13*b* is configured to fit female housing 3 in the inner space thereof. Various guide members for guiding the female housing 3 inside the inner space side and various locking members for locking the female housing 3 are provided on an inner peripheral surface of the fitting hood portion 13*b*. In a state where the female housing 3 is fitted in the fitting hood portion 13*b*, each tab exit port 134 of the terminal accommodating portion 13*a* is disposed opposite to the tab insertion port 34 of the female housing 3, allowing the tab 19 of the male terminal 14 made to exit from the tab exit port 134 to be inserted into the female terminal 4 through the tab insertion port 34 (see FIG. 1).

As illustrated in FIGS. 7 and 9, like the female terminal housing chamber 5, the male terminal housing chamber 15 is formed as a substantially rectangular space defined by a first inner wall surface 151, a second inner wall surface 152, a third inner wall surface 153, a fourth inner wall surface 154, and the like. Further, as illustrated in FIG. 7, a lance 16 having the same configuration as that of the lance 6 of the female terminal housing chamber 5 is provided in the second inner wall surface 152 of the male terminal housing chamber 15. Each of elements (locking pawl portion 161, slope 161*a*, and locking surface 161*b*) of the lance 16 has the same shape and function as those of each of elements (locking pawl portion 61, slope 61*a*, and locking surface 61*b*) of the lance 6. Further, an adjacent space portion 135 provided for each male terminal housing chamber 15 has the same shape and function as those of the adjacent space portion 35 of the female terminal housing chamber 5.

The male terminal 14 is a terminal fitting obtained with the same material as that of the female terminal 4 and obtained by the same processing as that thereof. As illustrated in FIGS. 6 to 8, the male terminal 14 has a box portion 17, a core wire caulking portion 141, and a wire caulking portion 142. The core wire caulking portion 141 and wire caulking portion 142 have the same configurations as those of the core wire caulking portion 41 and wire caulking portion 42 of the female terminal 4.

Like the box portion 7 of the female terminal 4, the box portion 17 has a rectangular cylindrical shape elongated in the extending direction and has a substantially rectangular shape in cross section as viewed in the extending direction, as illustrated in FIG. 9. The box portion 17 has a bottom plate 171 extending in the extending direction, a pair of side plates 172 and 173 rising in the height direction from width direction both edge ends of the bottom plate 171, a top plate 174 formed so as to be bent from a protruding end (upper edge end) of the side plate 173 toward the side plate 172 and to be disposed opposite to the bottom plate 171. Further, the box portion 17 has a tab 19 formed at the male front side (leading end side) in the extending direction so as to extend in the extending direction. The tab 19 is formed so as to be inserted inside the box portion 7 of the female terminal 4 and be able to contact the contact spring 9 in the connector fitting state.

A lance hole 8 is formed in the bottom plate 171 of the box portion 17. As in the case of the lance hole 8 of the female terminal 4, in a state where the male terminal 14 is accommodated at a normal position in the male terminal housing chamber 15, the lance 16 provided in the male terminal housing chamber 15 can enter the lance hole 18, and the locking surface 161*b* of the lance 16 can be locked to a front end surface 18*a* of the lance hole 18 positioned at the front side in the extending direction (see FIGS. 1 and 13). Further, a protrusion 111 having the same shape and function as those of the protrusion 11 of the female terminal 4 is formed at an outer edge of the lance hole 18. When the lance 16 is fitted to the male terminal 14, a rear end surface 111*a* of the protrusion 111 and front end surface 18*a* of the lance hole 18 abut against the locking surface 161*b* of the lance 16.

As illustrated in FIGS. 1, 7, and 9, a rib 110 (first displacement suppressing portion) each having the same configuration as that of the rib 10 of the female connector 2 are formed in each of the first, second, third, and fourth inner wall surfaces 151, 152, 153, and 154 of the male terminal housing chamber 15. The ribs 110 are each formed so as to extend in the extending direction at the tab exit port 134 side position than the lance 16 on each inner wall. The ribs 110 are configured to contact the box portion 17 of the male terminal 14 and suppress movement of the male terminal 14 in the male terminal housing chamber 15 in a state where the male terminal 14 is accommodated at a normal position in the male terminal housing chamber 15. In other words, when being brought into contact with the male terminal 14 accommodated in the male terminal housing chamber 15, the ribs 110 can firmly retain the male terminal 14 in the male terminal housing chamber 15 and can suppress a relative displacement of the male terminal 14 to the male terminal housing chamber 15. Thus, even if vibration is transmitted from the wire connected to the male terminal 14 upon connector fitting, it is possible to suppress vibration from being generated in the male terminal 14 to thereby suppress the vibration from being transmitted to the female terminal 4 side. The relative displacement of the male terminal 14 to the male terminal housing chamber 15 refers mainly to perturbation (backlash) along the height direction perpendicular to the male insertion direction, but includes also perturbation, movement, and displacement of the male terminal 14 along directions other than the height direction.

There are provided two ribs 110 on each inner wall surface. As a result, it is possible to satisfactorily maintain contact states with the bottom plate 171, side plates 172, 173, and top plate 174 of the box portion 17 of the male terminal 14. That is, in the present embodiment, the ribs 110 are provided at eight places in the male terminal housing chamber 15. A configuration may be possible, in which the ribs 110 are not provided on any of the first, second, third, and fourth inner wall surfaces 151, 152, 153, and 154 in the female terminal housing chamber 5.

The ribs 110 are provided at the tab exit port 134 side position than the lance 16 on each inner wall. With this configuration, in an insertion operation of the male terminal 14 (operation of inserting the male terminal 14 from the male terminal insertion port 133 so as to accommodate the male terminal 14 at a predetermined normal position in the extending direction inside the male terminal housing chamber 15), the ribs 110 start to come into contact with the male terminal 14 at the tab exit port 134 side position than a position where a required insertion force for moving the male terminal 14 in the extending direction becomes maximum. As a result, the male connector 12 of the present embodiment can retain the male terminal 14 in the male terminal housing chamber 15 more firmly without increasing the maximum value of the required insertion force. That is, it is possible to achieve both suppression of the relative displacement of the male terminal 14 to the male terminal housing chamber 15 and securement of easy insertion of the male terminal 14 into the male terminal housing chamber 15.

Figure 10:
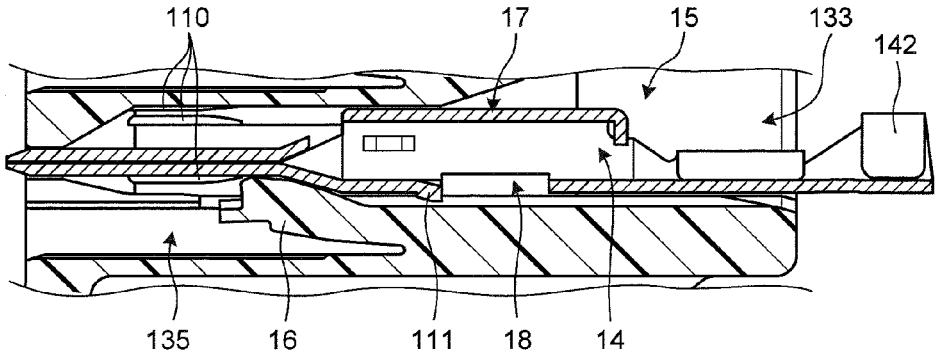
FIG. 10 is a view illustrating a first step of an insertion operation of the male terminal into a male terminal housing chamber in the present embodiment and is a longitudinal cross-sectional view of the male connector illustrating a state where the male terminal starts to come into contact with a lance.
Figure 11:
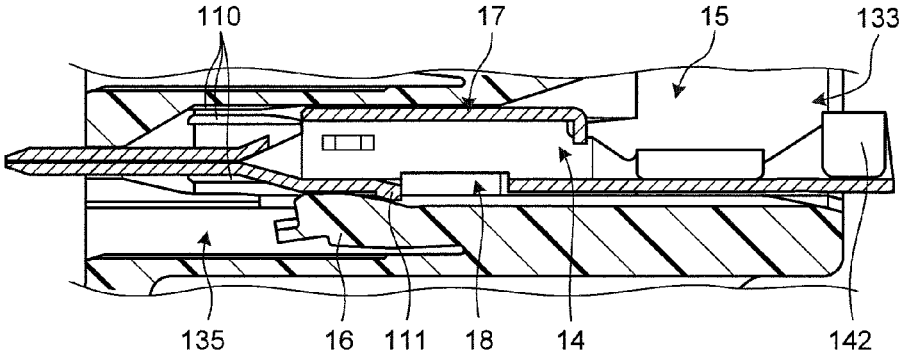
FIG. 11 is a view illustrating a second step of the insertion operation of the male terminal into the male terminal housing chamber in the present embodiment and is a longitudinal cross-sectional view of the male connector illustrating a state where an insertion force is maximum.
Figure 12:
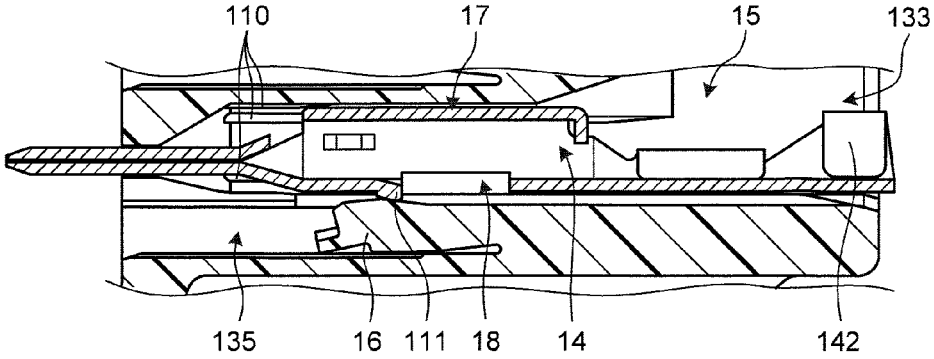
FIG. 12 is a view illustrating a third step of the insertion operation of the male terminal into the male terminal housing chamber in the present embodiment and is a longitudinal cross-sectional view of the male connector illustrating a state where the male terminal is inserted against ribs.
Figure 13:
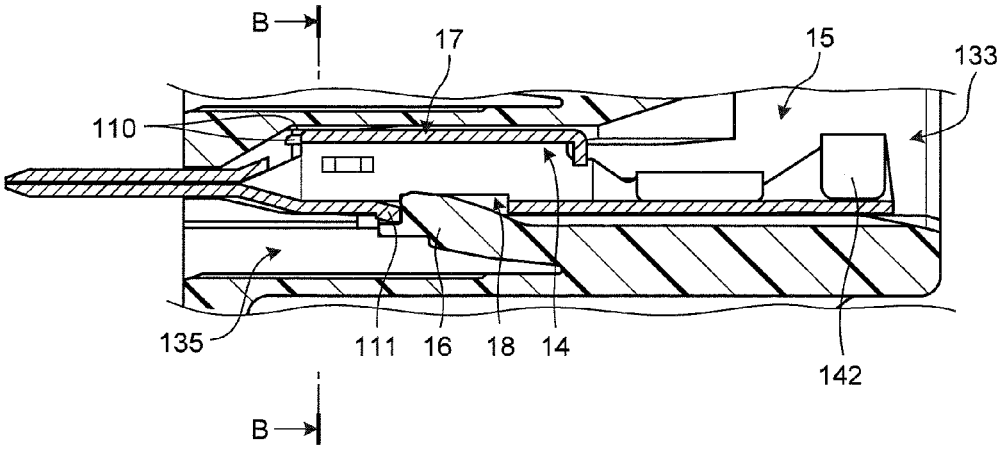
FIG. 13 is a view illustrating a fourth step of the insertion operation of the male terminal into the male terminal housing chamber in the present embodiment and is a longitudinal cross-sectional view of the male connector illustrating a state where the male terminal has been accommodated at a normal position inside the male terminal housing chamber.

The following describes an insertion operation of the male terminal 14 in the male connector 12 in the present embodiment with reference to FIGS. 10 to 13. FIG. 10 is a view illustrating a first step of the insertion operation of the male terminal into the male terminal housing chamber in the present embodiment and is a longitudinal cross-sectional view of the male connector illustrating a state where the male terminal starts to come into contact with the lance. FIG. 11 is a view illustrating a second step of the insertion operation of the male terminal into the male terminal housing chamber in the present embodiment and is a longitudinal cross-sectional view of the male connector illustrating a state where an insertion force is maximum. FIG. 12 is a view illustrating a third step of the insertion operation of the male terminal into the male terminal housing chamber in the present embodiment and is a longitudinal cross-sectional view of the male connector illustrating a state where the male terminal is inserted against the ribs. FIG. 13 is a view illustrating a fourth step of the insertion operation of the male terminal into the male terminal housing chamber in the present embodiment and is a longitudinal cross-sectional view of the male connector illustrating a state where the male terminal has been accommodated at a normal position inside the male terminal housing chamber.

As illustrated in FIGS. 6 and 7, when the male terminal 14 is inserted into the male terminal housing chamber 15 from the male terminal insertion port 133 of the male housing 13 in the male insertion direction in the extending direction and is made to advance in the inner space of the male terminal housing chamber 15 in the male insertion direction, a leading end of the box portion 17 of the male terminal 14 abuts against the slope 161*a* of the locking pawl portion 161 of the lance 16 as illustrated in FIG. 10 (first step). When the male terminal 14 abuts against the lance 16 protruding toward the inner space of the male terminal housing chamber 15, it receives, from the lance 16, resistance against a further movement in the male insertion direction. Thus, after the male terminal 14 abuts against the lance 16, it is necessary to add to the male terminal 14, from the male insertion direction, an insertion force required to further insert the male terminal 14 in the male terminal housing chamber 15 against the resistance of the lance 16. In the following description, a minimum external force required to move, in the extending direction (particularly, male insertion direction), the male terminal 14 in the male terminal housing chamber 15 against the resistance of the lance 16 (and ribs 110 to be described later) is referred to as "required insertion force". The required insertion force may be changed according to a change in a contact point or a contact direction between the male terminal 14 and lance 16. The required insertion force can also be referred to as a reaction force with respect to the male insertion direction external force added to the male terminal 14.

With this required insertion force, the male terminal 14 presses the slope 161*a* of the lance 16 in the male insertion direction. As a result, the slope 161*a* generates a component force that presses downward the entire lance 16 in the height direction, and the lance 16 is bent/deformed to the adjacent space portion 135 side by the component force. The male terminal 14 is inserted into the male terminal housing chamber 15 while bending/deforming (elastically deforming) the lance 16 by the required insertion force added thereto. With the advancement of the male terminal 14 in the male terminal housing chamber 15, the leading end of the box portion 17, bottom plate 171, and protrusion 111 are sequentially brought into contact with the slope 161*a* of the lance 16 in the order mentioned. Then, as illustrated in FIG. 11 (second step), the slope 161*a* of the lance 16 receives abutment of the protrusion 111 of the male terminal 14, and the locking pawl portion 161 retreats from the male terminal housing chamber 15 to the adjacent space portion 135. In this state, the required insertion force becomes a maximum value P1 (see FIG. 15), and then a bending deformation amount (elastic deformation amount) of the lance 16 becomes a maximum value. At this time, as illustrated in FIG. 11, the wire caulking portion 142 of the male terminal 14 protrudes from the male terminal insertion port 133.

After the required insertion force of the male terminal 14 reaches the maximum value P1, the insertion operation of the male terminal 14 is continued by the inertial force. Then, as illustrated in FIG. 12 (third step), the leading end of the box portion 17 of the male terminal 14 starts to come into contact with the ribs 110 provided in the first, second, third, and fourth inner wall surfaces 151, 152, 153, and 154. The male terminal 14 abuts against the ribs 110 protruding to the inner space of the male terminal housing chamber 15, whereby it receives, from the ribs 110, resistance against a further movement in the male insertion direction. Thus, after the male terminal 14 abuts against the ribs 110, a required insertion force for further inserting the male terminal 14 into the male terminal housing chamber 15 against the resistance of the ribs 110 is added to the male terminal 14 in the male insertion direction.

With this required insertion force, the male terminal 14 presses the ribs 110 in the male insertion direction. As a result, the male terminal 14 is further inserted into the male terminal housing chamber 15 against the resistance of the ribs 110. Thereafter, the male terminal 14 reaches the deepest portion of the male terminal housing chamber 15, whereby the insertion operation of the male terminal 14 is completed (that is, male terminal 14 is accommodated at a normal position inside the male terminal housing chamber 15) as illustrated in FIG. 13 (fourth step). More in detail, when the protrusion 111 of the male terminal 14 rides over an extending direction front side end portion of the slope 161*a* of the lance 16 to the male front side than the locking pawl portion 161, the lance 16 gets into a free state and elastically restored. As a result, the locking pawl portion 161 is fitted in the lance hole 18 of the male terminal 14, and the locking surface 161*b* of the locking pawl portion 161 abuts against the front end surface 18*a* of the lance hole 18 of the male terminal 14 and the rear end surface 111*a* of the protrusion 111. In this state, the leading end portion of the box portion 17 of the male terminal 14 is clamped and stopped by the plurality of ribs 110 in the male terminal housing chamber 15, whereby the male terminal 14 is reliably retained in the male terminal housing chamber 15. Further, in this state, the wire caulking portion 142 of the male terminal 14 is inserted through the male terminal insertion port 133 and completely accommodated in the male terminal housing chamber 15.

Figure 14:
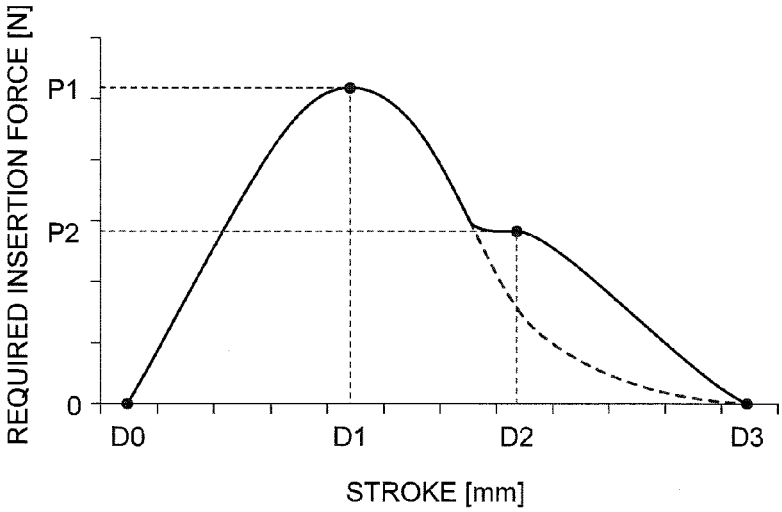
FIG. 14 is a view illustrating a relationship between a required insertion force of the male terminal during the insertion operation of the male terminal in the present embodiment and a stroke (insertion amount of the male terminal into the male terminal housing chamber)

The following further describes the insertion operation of the male terminal 14 in the present embodiment with reference to FIG. 14. FIG. 14 is a view illustrating a relationship between the required insertion force of the male terminal during the insertion operation of the male terminal in the present embodiment and a stroke (insertion amount of the male terminal into the male terminal housing chamber). In FIG. 14, a vertical axis represents a required insertion force [N], and a horizontal axis represents a stroke [mm]. In FIG. 14, a change in the required insertion force in the insertion operation illustrated in FIGS. 10 to 13 is illustrated by a solid line curve. The horizontal stroke of FIG. 14 represents a position corresponding to the first step of the insertion operation illustrated in FIG. 10 as D0, a position corresponding to the second step illustrated in FIG. 11 as D1, a position corresponding to the third step illustrated in FIG. 12 as D2, and a position corresponding to the fourth step illustrated in FIG. 13 as D3.

As illustrated in FIG. 14, at the stroke D0 corresponding to the first step of the insertion operation, when the leading end of the box portion 17 of the male terminal 14 contacts the slope 161*a* of the lance 16 in the male terminal housing chamber 15, the required insertion force in the male insertion direction starts being added to the male terminal 14 so as to allow the male terminal 14 to further advance deeper while bending/deforming the lance 16. The required insertion force gradually increases as the stroke of the male terminal 14 increases, that is, as the bending deformation amount of the lance 16 increases and becomes the maximum value P1 at the stroke D1 corresponding to the second step of the insertion operation.

When the male terminal 14 is further inserted, the resistance of the lance 16 reduces and, accordingly, the required insertion force reduces. Then, when the leading end of the box portion 17 of the male terminal 14 contacts the ribs 110 in the male terminal housing chamber 15 at the stroke D2 corresponding to the third step of the insertion operation, the resistance of the ribs 110 is additionally applied, and the required insertion force increases once again to become a peak value P2. Thereafter, when the male terminal 14 is further inserted, the resistance of the ribs 110 reduces and, accordingly, the required insertion force reduces. As a result, the required insertion force becomes 0 at the stroke D3 corresponding to the fourth step of the insertion operation. In this state, the insertion operation of the male terminal 14 is completed.

A dashed line curve in FIG. 14 is a comparative example to the present embodiment, illustrating a change in the required insertion force in the insertion operation of the male terminal in a case where the ribs 110 are not provided in the male terminal housing chamber 15. As illustrated in FIG. 14, in the present embodiment, providing the ribs 110 in the male terminal housing chamber 15 increases the resistance applied to the male terminal 14 during the insertion operation, so that the required insertion force is greater than that in the comparative example in a section (mainly a section between the stroke D2 and stroke D3) where the male terminal 14 contacts the ribs 110.

As described above, in the present embodiment, the ribs 110 are provided at the tab exit port 134 side position than the lance 16 on each inner wall. With this configuration, in the insertion operation of the male terminal 14, the ribs 110 start to come into contact with the male terminal 14 at the tab exit port 134 side position (stroke D3 side) than a position (stroke D1 in FIG. 14) where the required insertion force becomes maximum in the insertion operation of the male terminal 14. As a result, the position D2 at which the peak value P2 of the required insertion force is generated by the resistance of the ribs 110 are inevitably located between the D1 and D3. Therefore, in the present embodiment, the configuration providing the ribs 110 has no influence on the maximum value P1 of the required insertion force, so that it is possible to suppress a relative displacement of the male terminal 14 to the male terminal housing chamber 15 without increasing the required insertion force.

Figure 15:
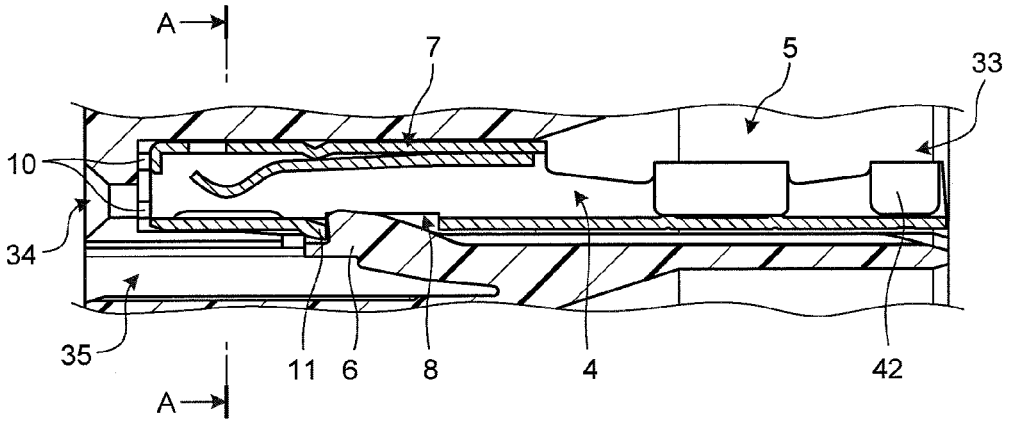
FIG. 15 is a longitudinal cross-sectional view of the female connector illustrating a state where the female terminal has been accommodated at a normal position inside the female terminal housing chamber.

The following describes an insertion operation of the female terminal 4 in the female connector 2 in the present embodiment with reference to FIGS. 3 and 15. FIG. 15 is a longitudinal cross-sectional view of the female connector illustrating a state where the female terminal is accommodated at a normal position inside the female terminal housing chamber. The insertion operation of the female terminal 4 in the female connector 2 is the same as that of the male terminal 14 described with reference to FIGS. 10 to 13. That is, as illustrated in FIG. 3, when the female terminal 4 is inserted into the female terminal housing chamber 5 from the female terminal insertion port 33 of the female housing 3 in the female insertion direction in the extending direction, the female terminal 4 advances into the female terminal housing chamber 5 while the lance 6 contacting the female terminal 4 is bent/deformed downward in the height direction. Then, at a time the female terminal 4 is inserted up to a normal position inside the female terminal housing chamber 5, the lance 6 is elastically restored, and the locking pawl portion 61 of the lance 6 is fitted in the lance hole 8 to lock the female terminal 4, as illustrated in FIG. 15. In this state, the locking surface 61*b* of the lance 6 locks the front end surface 8*a* of the lance hole 8 formed in the bottom plate 71 of the female terminal 4. Further, in this state, the leading end portion of the box portion 7 of the female terminal 4 is clamped and stopped by the plurality of ribs 10 in the female terminal housing chamber 5, whereby the female terminal 4 is reliably retained in the female terminal housing chamber 5.

Figure 16:
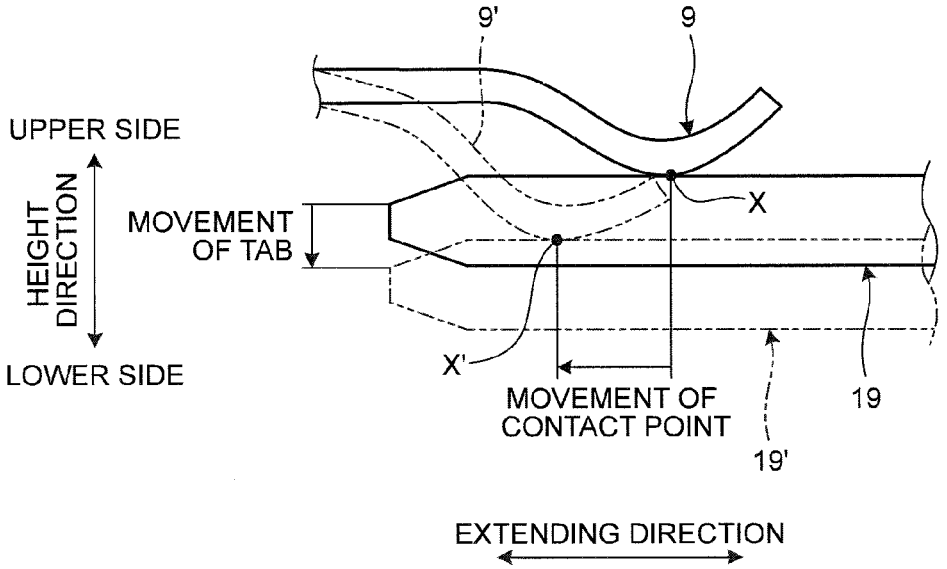
FIG. 16 is an exemplary view illustrating a contact state between a contact spring of the female terminal and a tab of the male terminal upon connector fitting.
Figure 17:
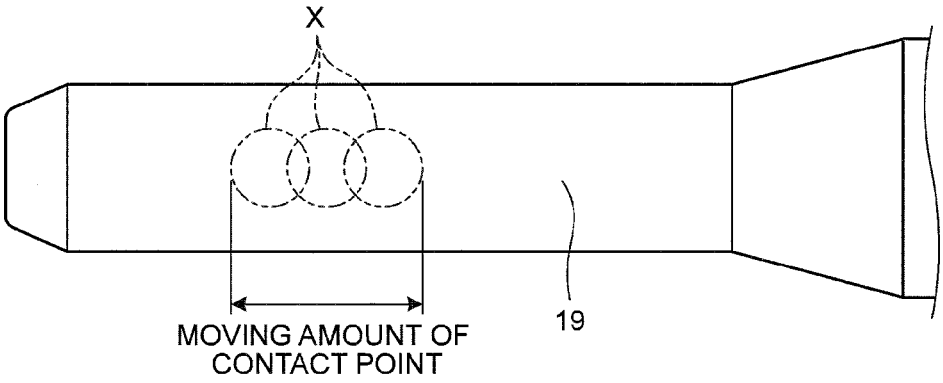
Prior Art FIG.17
FIG. 17 is an exemplary view illustrating a moving range of a contact position between a contact spring and a tab of the male terminal in a comparative example.
Figure 18:
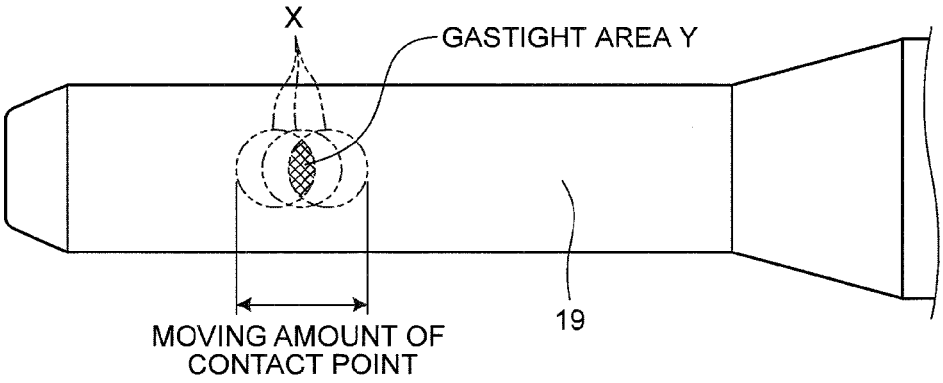
FIG. 18 is an exemplary view illustrating a moving range of the contact position between the contact spring and tab of the male terminal in the present embodiment.

As described above, in the connector 1 of the present embodiment, by providing the plurality of ribs 110 in the male terminal housing chamber 15 of the male connector 12, it is possible to suppress occurrence of the relative displacement (relative displacement of the male terminal 14 to the male terminal housing chamber 15) of the male terminal 14 accommodated in the male terminal housing chamber 15. Similarly, in the connector 1, by providing the plurality of ribs 10 in the female terminal housing chamber 5 of the female connector 2, it is possible to suppress occurrence of the relative displacement (relative displacement of the female terminal 4 to the female terminal housing chamber 5) of the female terminal 4 accommodated in the female terminal housing chamber 5. Thus, in the connector 1 of the present embodiment, by thus suppressing the relative displacement of the female terminal 4 and male terminal 14, it is possible to improve contact stability of a contact portion between the female terminal 4 and male terminal 14 upon connector fitting. With reference to FIGS. 16 to 18, effects of the connector 1 will be described in detail. FIG. 16 is an exemplary view illustrating a contact state between the contact spring of the female terminal and tab of the male terminal upon connector fitting. FIG. 17 is an exemplary view illustrating a moving range of a contact position between the contact spring and tab of the male terminal in a comparative example. FIG. 18 is an exemplary view illustrating a moving range of the contact position between the contact spring and tab of the male terminal in the present embodiment.

As illustrated in FIG. 16, upon connector fitting, the tab 19 of the male terminal 14 is inserted into the box portion 7 of the female terminal 4 and is pressurized in the height direction by the contact spring 9, whereby contact between the tab 19 and contact spring 9 is maintained at a contact point X (contact portion). Assume here that a backlash in the height direction occurs in the male terminal 14. At this time, a height direction position of the tab 19 of the male terminal 14 is fluctuated. For example, as indicated by a tab 19' in FIG. 16, the tab 19 is moved downward in the height direction so as to be separated from the contact spring 9. At this time, the contact spring 9 is biased toward the tab 19 side and is thus elastically restored downward in the height direction while following the tab 19', as indicated by a contact spring 9'. As a result, the contact point between the contact spring and tab moves in the extending direction from the contact point X between the contact spring 9 and tab 19 before the fluctuation to a contact point X' between the contact spring 9' and tab 19'. That is, with the height direction backlash of the male terminal 14, the contact point between the contact spring 9 of the female terminal 4 and tab 19 of the male terminal 14 slides on the tab 19 in the extending direction.

In each of FIGS. 17 and 18, the contact point X between the tab 19 of the male terminal 14 and the contact spring 9 of the female terminal 4 at an arbitrary time point is indicated by a circle, and a moving range of the contact point X during the fluctuation of the tab 19 is indicated by a plurality of circles. As illustrated in FIG. 17 as a comparative example, when a backlash in the female terminal 4 and male terminal 14 is large, a moving amount of the contact point X during the fluctuation of the tab 19 is large, so that there is no common portion among the contact points X at each time point during the fluctuation. On the other hand, as illustrated in FIG. 18, when the backlash of the female terminal 4 and male terminal 14 is suppressed by the configuration of the present embodiment, the moving amount of the contact point X during the fluctuation of the tab 19 is smaller than that in the comparative example, so that a common portion Y is generated among the contact points X at each time point during the fluctuation. The common portion Y is a portion where the contact spring 9 and tab 19 always contact each other irrespective of sliding, of the contact point X between the contact spring 9 and tab 19, on the tab 19. The common portion Y is a portion that is not exposed to the atmosphere even when the contact point X slides and can be expressed as so-called a gastight area. In the gastight area, occurrence of surface oxidation or surface wear is suppressed, and thus it is considered that a satisfactory contact state is maintained.

As described above, by providing the ribs 10 and 110 in the female terminal housing chamber 5 and male terminal housing chamber 15, respectively, the connector 1 of the present embodiment can suppress the backlash (relative displacement) of the female terminal 4 and male terminal 14. This reduces an amount of slide of the contact point X between the contact spring 9 and tab 19 upon connector fitting on the tab 19, which is the contact point between the female terminal 4 and male terminal 14, allowing a gastight area to be ensured in the moving range of the contact point X to be slid. As a result, it is possible to improve contact stability of the contact point between the female terminal 4 and male terminal 14 upon connector fitting. The improvement of the contact stability upon connector fitting allows suppression of wear at the contact point.

Further, as described with reference to FIG. 14, in the connector 1 of the present embodiment, the ribs 10 and 110 provided in the female terminal housing chamber 5 and male terminal housing chamber 15, respectively, are formed so as to start to come into contact with the female terminal 4 and male terminal 14 at a deeper side (tab insertion port 34 side, tab exit port 134 side) than a position where the required insertion force becomes maximum in the insertion operation of the female terminal 4 and male terminal 14. This allows the female terminal 4 and male terminal 14 to be accommodated in the female terminal housing chamber 5 and male terminal housing chamber 15, respectively, without increasing the maximum value of the required insertion force. Thus, it is possible to secure easy insertion of the female terminal 4 and male terminal 14 into the female terminal housing chamber 5 and male terminal housing chamber 15, respectively, while retaining more firmly the female terminal 4 and male terminal 14 in the female terminal housing chamber 5 and male terminal housing chamber 15, respectively.

Further, in the connector 1 of the present embodiment, the ribs 10 provided in the female terminal housing chamber 5 and ribs 110 provided in the male terminal housing chamber 15 suppress the relative displacement of the female terminal 4 and male terminal 14 to thereby ensure a gastight area at a contact point (contact point X illustrated in FIGS. 16 to 18) between the tab 19 of the male terminal 14 and contact spring 9 of the female terminal 4. This allows a satisfactory contact state of the terminal contact point to be maintained, thereby improving further the contact stability.

Although the embodiment of the present invention has been described, it should be understood that the above embodiment is illustrative and does not limit the scope of the invention. The present invention can be practiced in various other forms, and various omissions, substitutions and changes may be made without departing from the scope of the invention. The embodiment and modification thereof are included in the scope or spirit of the present invention and in the appended claims and their equivalents.

Although a non-waterproof connector is taken as an example of the connector 1 in the above embodiment, the present invention may be applied to a waterproof connector.

In the above embodiment, as a means for suppressing the relative displacement of the female terminal 4 to the female terminal housing chamber 5, a configuration in which the ribs 10 are provided in the female terminal housing chamber 5 of the female connector 2 is exemplified. However, any other element than the rib 10 may be used as long as it can suppress the relative displacement (backlash) of the female terminal 4 to the female terminal housing chamber 5 by contacting the female terminal 4 accommodated in the female terminal housing chamber 5. For example, a configuration may be adopted, in which a force for retaining the female terminal 4 is increased by modifying a shape or a property of a part of the inner wall surface of the female terminal housing chamber 5. Alternatively, the ribs 10 and other element may be used together for suppressing the relative displacement of the female terminal 4 to the female terminal housing chamber 5.

Similarly, in the above embodiment, as a means for suppressing the relative displacement of the male terminal 14 to the male terminal housing chamber 15, a configuration in which the ribs 110 are provided in the male terminal housing chamber 15 of the male connector 12 is exemplified. However, any other element than the rib 110 may be used as long as it can suppress the relative displacement of the male terminal 14 to the male terminal housing chamber 15 by contacting the male terminal 14 accommodated in the male terminal housing chamber 15. For example, a configuration may be adopted, in which a force for retaining the male terminal 14 is increased by modifying a shape or a property of a part of the inner wall surface of the male terminal housing chamber 15. Alternatively, the ribs 110 and other element may be used together for suppressing the relative displacement of the male terminal 14 to the male terminal housing chamber 15.

In the above embodiment, the ribs 10 are provided in the female terminal housing chamber 5 of the female connector 2, and ribs 110 are provided in the male terminal housing chamber 15 of the male connector 12 so as to suppress the relative displacement of the female terminal 4 and male terminal 14 and thus to improve the contact stability of the contact point between the female terminal 4 and male terminal 14. However, one of the ribs 10 and ribs 110 may be omitted. That is, a configuration may be adopted, in which the ribs 10 are provided in the female terminal housing chamber 5 of the female connector 2, while the ribs 110 are not provided in the male terminal housing chamber 15 of the male connector 12, or in which the ribs 110 are provided in the male terminal housing chamber 15 of the male connector 12, while the ribs 10 are not provided in the female terminal housing chamber 5 of the female connector 2. Note that when considering a fitting state between the female terminal 4 and male terminal 14, the female terminal 4 is often moved in association with the male terminal 14. That is, it can be considered that suppressing the relative displacement of the male terminal 14 can also suppress the displacement of the female terminal 4. Therefore, it is preferable to make the number of the ribs 110 to be provided in the male terminal housing chamber 15 of the male connector 12 larger than the number of ribs 10 to be provided in the female terminal housing chamber 5 of the female connector 2, so as to suppress the relative displacement of the male terminal 14 more effectively than that of the female terminal 4.

Further, in the above embodiment, a configuration in which two ribs 10 are provided on one inner wall surface of the female terminal housing chamber 5 of the female connector 2, and a configuration in which two ribs 110 are provided on one inner wall surface of the male terminal housing chamber 15 of the male connector 12 are exemplified; however, the present invention is not limited to this, but one or three or more ribs 10 (110) may be provided on one inner wall surface.

Further, in the above embodiment, as an example of a configuration in which the contact portion between the male terminal 14 and male terminal housing chamber 15 of the male connector 12 that contact each other during insertion operation is formed so as to make the required insertion force reach the maximum value P1 before the entire male terminal 14 is accommodated in the male terminal housing chamber 15, a configuration in which the protrusion 111 is provided at the outer edge of the lance hole 18 of the male terminal 14 is exemplified; however, configurations other than the above may be adopted. For example, a protrusion may be provided on the slope 161*a* of the lance 16. Alternatively, a protruding amount of the slope 161*a* of the lance 16 toward the male terminal housing chamber 15 side may be increased. In other words, the slope 161*a* of the lance 16 may be formed so as to make the required insertion force reach the maximum value in a state where a part of the male terminal 14 is protruded from the male terminal insertion port 133. Similar configurations can be applied to the female connector 2.

Further, in the above embodiment, a configuration in which the locking pawl portion 161 of the lance 16 in the male terminal housing chamber 15 of the male connector 12 is fitted in the lance hole 18 of the male terminal 14 is exemplified; however, locking mechanism other than the above may be adopted. For example, the lance hole 18 may not be provided in the male terminal 14, and the lance 16 in the male terminal housing chamber 15 may be locked to a rear end of the box portion 17 of the male terminal 14. In this case, in order to make the characteristic of the insertion force maximum value P1 the same as that in the above embodiment, the protrusion 111 having the same configuration as that in the above embodiment may be provided at a part of an outer peripheral surface of the box portion 17 that abuts against the lance 16 during the insertion operation. Alternatively, a protrusion may be formed on the slope 161*a* of the lance 16 or a protruding amount of the lance 16 toward the inner space of the male terminal housing chamber 15 may be increased.

The connector according to the present invention suppresses the relative displacement of the male terminal to the male terminal housing chamber in the male connector or suppresses the relative displacement of the female terminal to the female terminal housing chamber in the female connector. This can suppress a relative displacement between the male and female terminals, thereby improving contact stability of a contact portion between the male and female terminals.

What is claimed is:

1. A connector comprising:

a male connector including a male housing, a male terminal having a tab at a leading end thereof, and a male terminal housing chamber configured to extend inside the male housing, be formed in a hollow shape, and have a male terminal insertion port and a tab exit port provided at first and second sides thereof in its extending direction, respectively; and a female connector including a female housing, a female terminal configured to have an elastic contact piece contacting the tab of the male terminal inserted thereinto, and a female terminal housing chamber configured to extend inside the female housing, be formed in a hollow shape, and have a female terminal insertion port and a tab insertion port provided at the second and first sides thereof in its extending direction, respectively, wherein the male and female connectors are configured to have at least one of a first and second displacement suppressing portions, the first displacement suppressing portion being provided in the male terminal housing chamber and configured to suppress a relative displacement of the male terminal to the male terminal housing chamber by being brought into contact with the male terminal accommodated in the male terminal housing chamber, the second displacement suppressing portion being provided in the female terminal housing chamber and configured to suppress a relative displacement of the female terminal to the female terminal housing chamber by being brought into contact with the female terminal accommodated in the female terminal housing chamber, the first displacement suppressing portion is formed so as to start to come into contact with the male terminal at a tab exit port side position than a position where a required insertion force capable of moving the male terminal in the extending direction becomes maximum in an insertion operation of inserting the male terminal from the male terminal insertion port so as to accommodate the male terminal at a predetermined normal position in the extending direction inside the male terminal housing chamber, the second displacement suppressing portion is formed so as to start to come into contact with the female terminal at a tab insertion port side position than a position where a required insertion force capable of moving the female terminal in the extending direction becomes maximum in an insertion operation of inserting the female terminal from the female terminal insertion port so as to accommodate the female terminal at a predetermined normal position in the extending direction inside the female terminal housing chamber.

2. The connector according to claim 1, wherein the male connector has a lance, the lance being formed so as to protrude from an inner wall surface of the male terminal housing chamber toward an inside thereof and to be elastically deformable toward an outside of the male terminal housing chamber and being configured to lock the male terminal when the male terminal is accommodated at the normal position, the first displacement suppressing portion has a rib provided on the inner wall surface, along the extending direction, at the tab exit port side position than the lance, the female connector has a lance, the lance being formed so as to protrude from an inner wall surface of the female terminal housing chamber toward an inside thereof and to be elastically deformable toward an outside of the female terminal housing chamber and being configured to lock the female terminal when the female terminal is accommodated at the normal position, and the second displacement suppressing portion has a rib provided on the inner wall surface, along the extending direction, at the tab insertion port side position than the lance.

3. The connector according to claim 2, wherein the male terminal housing chamber and female terminal housing chamber are each formed by a plurality of the inner wall surfaces, and the first and second displacement suppressing portions have at least two ribs on one of the plurality of inner wall surfaces.

4. The connector according to claim 1, wherein in a state where the male and female terminals are fitted to each other, the first and second displacement suppressing portions are formed so as to ensure a gastight area at a contact portion between the tab of the male terminal and the elastic contact piece of the female terminal.

5. The connector according to claim 2, wherein in a state where the male and female terminals are fitted to each other, the first and second displacement suppressing portions are formed so as to ensure a gastight area at a contact portion between the tab of the male terminal and the elastic contact piece of the female terminal.

6. The connector according to claim 3, wherein in a state where the male and female terminals are fitted to each other, the first and second displacement suppressing portions are formed so as to ensure a gastight area at a contact portion between the tab of the male terminal and the elastic contact piece of the female terminal.

* * * * *